US005217392A

United States Patent [19]

Hosler, Sr.

[11] Patent Number: 5,217,392

[45] Date of Patent: Jun. 8, 1993

[54] COAXIAL CABLE-TO-CABLE SPLICE CONNECTOR

[75] Inventor: Robert C. Hosler, Sr., Marysville, Pa.

[73] Assignee: The Whitaker Corporation, Wilmington, Del.

[21] Appl. No.: 975,751

[22] Filed: Nov. 13, 1992

[51] Int. Cl.[5] ..... H01R 9/07

[52] U.S. Cl. ..... 439/585; 29/869; 174/88 C; 439/638

[58] Field of Search ..... 439/578-585, 439/638, 650, 651, 652, 654, 655, 675, 932, 877; 29/857, 861, 863, 868, 869, 871; 174/75 C, 88 C

[56] References Cited

U.S. PATENT DOCUMENTS

| | | | |
|---|---|---|---|
| 2,904,619 | 9/1959 | Forney, Jr. | 174/88 C |
| 3,001,003 | 9/1961 | Robinson | 174/88 C |
| 3,331,917 | 7/1967 | O'Keefe et al. | 174/75 C |
| 3,441,659 | 4/1969 | Taudig et al. | 174/88 C |
| 3,525,799 | 8/1970 | Ellis | 174/84 |
| 3,737,840 | 6/1973 | Hoffman | 339/273 F |
| 3,828,305 | 8/1974 | Hogendobler | 339/177 R |
| 3,859,455 | 1/1975 | Gommans et al. | 174/88 C |
| 3,872,237 | 3/1975 | Eyre et al. | 174/88 C |
| 3,879,103 | 4/1975 | Peltola et al. | 339/177 R |
| 3,983,457 | 9/1976 | Smith | 317/99 |
| 4,341,921 | 7/1982 | Simpson | 174/84 R |
| 4,583,811 | 4/1986 | McMills | 339/177 R |
| 4,595,724 | 6/1986 | Koblitz | 524/409 |
| 4,613,199 | 9/1986 | McGeary | 339/177 R |
| 4,688,878 | 8/1987 | Cohen et al. | 439/585 |
| 4,834,676 | 5/1989 | Tackett | 439/584 |
| 4,869,690 | 9/1989 | Frear et al. | 439/675 |
| 4,902,252 | 2/1990 | Whorton et al. | 439/796 |
| 5,035,660 | 7/1991 | Werner | 439/796 |
| 5,062,808 | 11/1991 | Hosler, Sr. | 439/580 |
| 5,070,314 | 12/1991 | Decker | 333/260 |
| 5,083,943 | 1/1992 | Tarrant | 439/583 |

*Primary Examiner*—David L. Pirlot
*Attorney, Agent, or Firm*—Anton P. Ness

[57] ABSTRACT

A splice connector (10) includes first and second outer shells (20,50) which are press fit together and secure therewithin an inner dielectric sleeve (80) defining a subassembly (12). Inner contacts (100,110) are terminated onto inner conductors of coaxial cables (160,170) and insertable into a bore (82) of the inner sleeve (80) and mate therewithin during assembly. Inner ferrules (120,140) are placed over the outer jackets of the cables, lengths of the Outer jacket (162,172) are removed and the shielding braid (164,174) folded back over forward portions (128,148) of ferrules (120,140), and the ends of the cables are inserted into large recesses (28,58) of the subassembly (12). The annular flanges (30,60) of the outer shells (20,50) defining the large recesses are then crimped onto the ferrule forward portions (128,148) carefully but firmly compressing the shielding braids (164,174) between the flange and ferrule surfaces to define an electrical grounding connection and also forming a splice joint (14).

14 Claims, 4 Drawing Sheets

COAXIAL CABLE-TO-CABLE SPLICE CONNECTOR

FIELD OF THE INVENTION

The present invention relates to the field of electrical connectors and more particularly to connectors for coaxial cables.

BACKGROUND OF THE INVENTION

In certain instances it is desirable to splice an end of one coaxial cable to that of another, with the inner conductors electrically interconnected and the outer conductors electrically connected precisely coaxially therearound, while not requiring matable connectors to be terminated to respective ones of the cable ends. Such an in-line splice must provide a mechanical joint between the cable ends, all with minimal signal loss. One use for such a splice would be to join a coaxial cable from an antenna to a cable of the base station of a cordless telephone, for residential use where the antenna must be mounted externally to the home such as on the roof to extend the range of the cordless telephone.

It is desired to provide a kit of parts enabling the formation of such an in-line splice with minimal skill sensitive manipulation and with only standard tools.

It is also desired to provide such a kit of parts adapted for joining coaxial cables of different sizes, with as few different parts as possible.

It is further desired to provide a splice connector for use with coaxial cables to transmit signals in the frequency range of up to 2 gigahertz.

SUMMARY OF THE INVENTION

The present invention provides a kit of parts including a pair of outer conductive shells of malleable metal, a single dielectric inner sleeve, a matable pair of pin-and-socket inner contacts with identical outer diameters for receipt into a bore of the inner dielectric sleeve, a pair of optional dielectric spacers and a pair of interior crimping ferrules. The inner dielectric sleeve is cylindrical with an outer diameter selected to fit snugly in the inner portions of the profiled central bores of the outer shells, when the outer shells are placed over the respective ends of the dielectric sleeve. The outer conductive shells are adapted to interfit in male-female fashion, with one having an annular flange extending from an inner face thereof to be received into a complementary annular recess defined in the inner face of the other in a press fit; smaller diameter central portions of the profiled central bores have limited axial dimensions and define precisely located stops securing the dielectric sleeve therewithin upon assembly. The outer ends of the conductive shells have thin walls defining crimping barrels of identical large diameters.

The outer conductive shells and inner dielectric sleeve comprise a subassembly having cable-receiving outer ends adapted to receive the cable ends thereinto after the cable ends have been stripped of their outer insulation to expose the shielding braid, and after end portions of the inner cable conductors have been exposed by removal of a length of the inner insulation and the inner contacts have been terminated to the inner conductors such as by soldering or crimping, the inner contacts having inner diameters slightly larger than the nominal diameters of inner conductors of standard coaxial cables. Each inner ferrule is placed onto a respective cable end prior to insertion of the cable ends into the subassembly, and the exposed shielding braid of the cable is rolled backwardly over the rounded inner face of the inner ferrule to be disposed against a preferably knurled outer surface thereof.

The thus-prepared cable end is inserted into a respective outer end or crimping barrel of an outer shell of the subassembly, with the braid-covered outer surface of the inner ferrule received into a respective crimping barrel until a transverse flange of the inner ferrule abuts the outer end of the corresponding outer shell, as the inner contacts have become fully mated. The crimping barrels are then respectively crimped inwardly onto the braid-covered inner ferrules, thus electrically connecting the outer conductive shells to the shielding braids of the cables.

The kit of parts is adapted for use with any of several standard sizes of coaxial cables, by having two inner ferrules for each standard size, with only the inner diameters of the inner ferrules varying to be received over the outer jacket of a particular size of coaxial cable, and the inner diameters of the conductor-receiving barrels of the inner contacts varying to receive thereinto and be terminated to inner conductors of the particular size of coaxial cable. Preferably the smaller diameter center portions of the outer shell bores have a diameter selected to accommodate receipt of an end portion of the inner insulative jacket of the largest standard coaxial cable with which the kit is adapted to be used. Also preferably dielectric spacers of resilient material are placed onto the prepared cable ends just forwardly of the end of the shielding braids after the braid ends have been rolled backwardly over the inner ferrule forward ends.

It is an objective of the present invention to provide a kit of parts suitable for splicing ends of coaxial cables which may be of different sizes, with a minimum of parts enabling a simple splice operation.

It is also an objective that the parts of the kit be adapted to be used to provide a splice connection of high integrity with minimized technique sensitivity.

It is further an objective that as much of the kit of parts be standardized in size and shape from kit to kit for simplicity of parts inventory which reduces costs and eliminates potential for improper assembly both in the factory and during the splicing operation in the field.

It is additionally an objective that such a kit include an outer shell/inner dielectric sleeve subassembly with identical cable-receiving ends to minimize any potential for improper assembly when applied to cables of different sizes.

It is also an objective to provide a connector useful in splicing cables especially suitable for signal transmission in the range of up to about 2 gigahertz.

An embodiment of the present invention will now be described by way of example with reference to the accompanying drawings.

DETAILED DESCRIPTION OF THE PREFERRED EMBODIMENT

Figure 1:
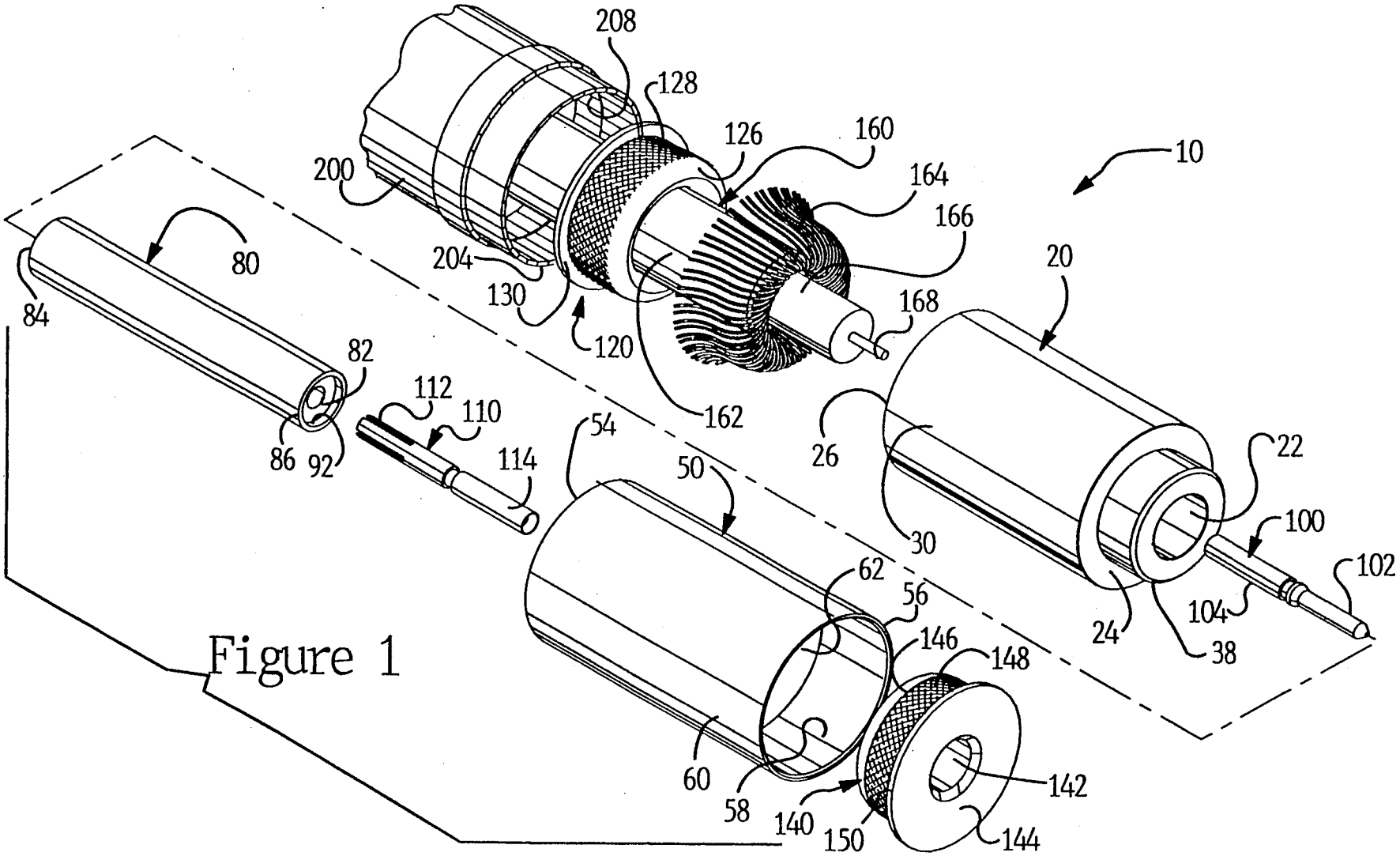
FIG. 1 is an exploded isometric view of the splice connector of the present invention, with one of the inner ferrules shown disposed on a representative prepared coaxial cable end.

The parts of the splice connector 10 of the present invention are shown in FIG. 1 to include first and second outer conductive shells 20,50, a single inner dielectric sleeve 80, first and second inner contacts 100,110, and first and second conductive inner ferrules 120,140. First inner ferrule 120 is shown placed onto the outer jacket 162 of an end portion of coaxial cable 160 which has been prepared to be spliced to an associated coaxial cable 170 (FIGS. 3 ad 4) during which preparation a portion of the outer jacket is stripped to expose the shielding braid 164.

Figure 2:
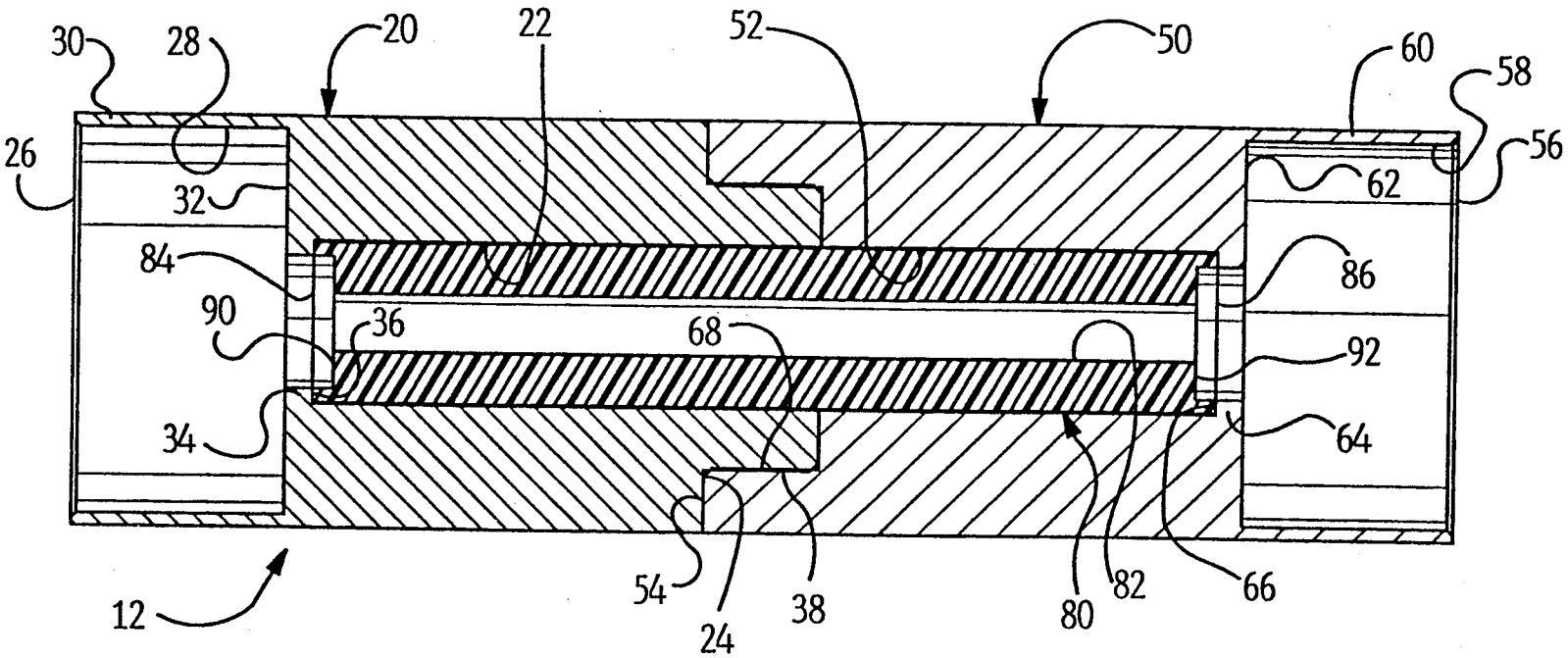
FIG. 2 is a longitudinal section view of the outer shell/dielectric sleeve subassembly ready to receive cable ends thereinto.

Preferably outer conductive shells 20,50 are secured about inner dielectric sleeve 80 during manufacturing to define a subassembly 12 (FIG. 2). The connector in practice is provided as a kit of parts ready for field application to coaxial cables in the field, each kit having a subassembly 12, matable pin and socket inner contacts 100,110 and a pair of inner ferrules 120,140 for each size of coaxial cable with which the kit is to be used. Optionally a pair of resilient dielectric spacers 190 may be provided, as shown in FIGS. 3 and 4.

Referring to FIGS. 1 and 2, inner dielectric sleeve 80 has a contact-receiving bore 82 extending therethrough from respective ends 84,86 and has an outer diameter and axial length selected to enable securing within outer shells 20,50. Each outer shell 20,50 has a profiled inner bore 22,52 extending from forward face 24,54 to rearward cable-receiving end 26,56, and each outer shell includes a large recess 28,58 at rearward end 26,56 defined by an annular flange 30,60 of limited wall thickness extending axially rearwardly from the outer cylindrical surface of the respective shell 20,50. Adjacent to bottom surfaces 32,62 of large recesses 28,58 is a bore section 34,64 having an inner diameter slightly smaller than that of center bore portion 22,52 and the corresponding outer diameter of inner dielectric sleeve 80, with smaller diameter bore sections 34,64 defining forwardly facing stop surfaces 36,66.

When outer conductive shells 20,50 are inserted over respective ends of inner dielectric sleeve 80, the outer shells are urged together, with stop surfaces 36,66 abutting end faces 84,86 of sleeve 80 for retention within subassembly 12. First outer shell 20 is shown to have an annular flange 38 extending axially forwardly of forward face 24, adapted to be received into complementary recess 68 in forward face 54 of second shell 50 in a press fit upon assembly of subassembly 12. Preferably chamfered peripheral edges are provided at least on annular flange 38 as a lead-in to facilitate being received into recess 68 during assembly. Also, preferably inner dielectric sleeve 80 includes recesses 90,92 in end faces 84,86 having a diameter about equal to small diameter bore sections 34,64 of outer shells 20,50 for receipt of an end portion of inner insulative jackets 166,176 of coaxial cables 160,170 (see FIG. 4).

Figure 3:
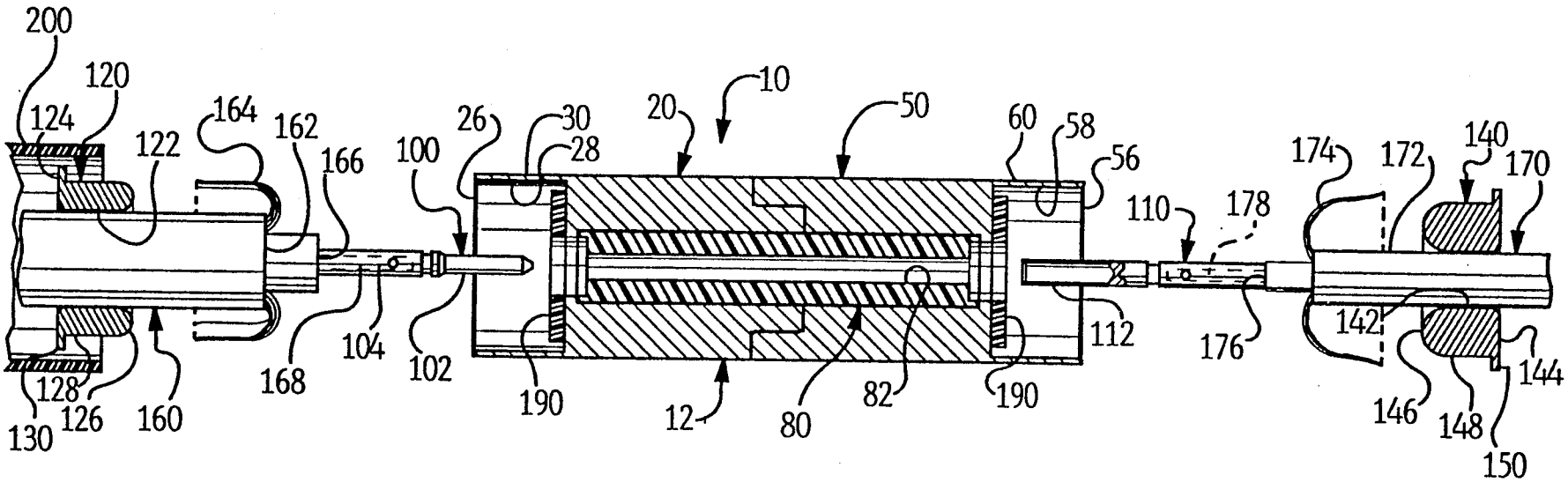
FIGS. 3 and 4 are longitudinal section views of the prepared cable ends with inner ferrules secured thereon about to be received into the cable-receiving ends of the subassembly of FIG. 2, and fully received thereinto and crimped, respectively.
Figure 4:
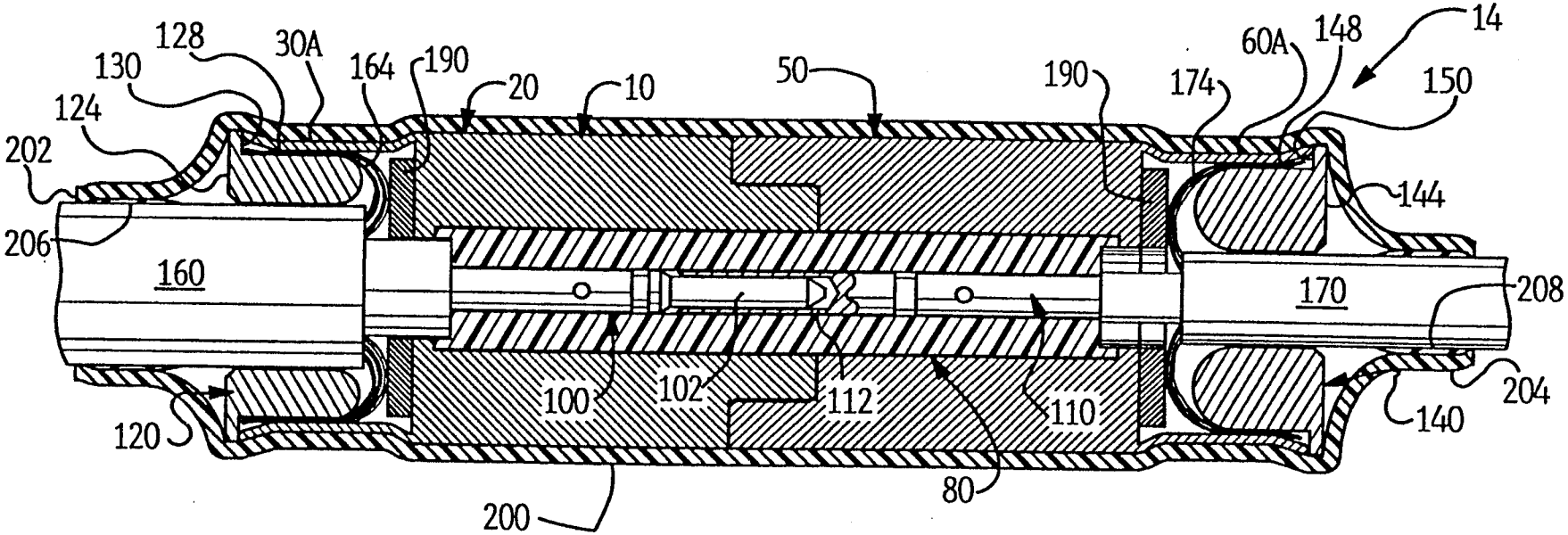

Referring to FIGS. 3 and 4, application of splice connector 10 to cables 160,170 is shown. Inner contacts 100,110 include matable pin contact section 102 and socket contact section 112 at forward ends thereof, and conductor-receiving barrels 104,114 at rearward ends thereof into which exposed end portions of inner cable conductors 168,178 will be inserted, for termination to inner contacts 100,110 such as by crimping or soldering. Inner ferrules 120,140 each include a cable-receiving passageway 122,142 of selected diameter therethrough from rearward face 124,144 to forward face 126,146. Preferably forward face 126,146 is rounded to remove sharp edges of the forward face which otherwise could damage the shielding braids during assembly and crimping, and outwardly facing surface portion 128,148 is preferably knurled. The outer diameter of inner ferrules 120,140 is selected to define annular gaps with the inner surfaces of annular flanges 30,60 of outer shells 20,50 within which ends of the cables' shielding braids will be disposed upon assembly, to provide clearance so that insertion of the cable ends into large cable-receiving recess 28,58 will occur without damage to the braids.

Inner ferrules 120,140 are then placed onto ends of coaxial cables 160,170 which are then prepared by removing end lengths of outer jacket 162,172 to expose end lengths of shielding braid 164,174 which are then spread and rolled back as is conventional during coaxial cable termination. Shorter end lengths of inner insulative jackets 166,176 are then removed to expose inner conductors 168,178. Inner conductors 168,178 are now inserted into conductor-receiving barrels 104,114 of inner contacts 100,110 and crimped therein or soldered therein, preferably with the rearward end of the inner contact abutting the end of the inner insulative jacket 166,176. Inner ferrules 120,140 are then brought forwardly along the outer insulative jacket 162,172 to be superposed over the outer jacket end, and the shielding braid wiped back over rounded forward faces 126,146 and overlaid atop outwardly facing surfaces 128,148.

For example, an end portion of the outer jacket of each cable is first removed having a length of 0.250 inches, and after the exposed shielding braid is folded back, an end portion of the inner insulative jacket is then removed having a length of 0.156 inches. Standard pin and socket contact members may be used having conductor-receiving barrels about 0.160 inches long, such as AMP Part Nos. 222190-1 and 222191-1. An inner dielectric sleeve of polytetrafluoroethylene material may be used. Outer shells may be used machined of brass permitting crimping of the annular flanges thereof which may have a wall thickness of about 0.012 inches. Inner ferrules may be used machined of brass and having a diameter of 0.325 inches along the outwardly facing surfaces of the forward portions thereof. The inner diameter of the cable-receiving recesses may be 0.351 inches to define an annular space before crimping of about 0.013 inches between the inner ferrule and the outer shell. A clearance of 0.046 inches may be provided between the forward faces of the inner ferrules and the bottom surface of the cable-receiving recesses. Optionally spacers of polymeric material may be used having a thickness of 0.030 inches.

Where a coaxial cable of 0.110 inches in diameter is to be spliced to a coaxial cable of 0.195 inches in diameter, the respective inner ferrules can have diameters of the central passageways about 0.201 inches and 0.118 inches respectively. Preferably the axial length of each crimped section is about 0.160 inches.

Preparation of the coaxial cables 160,170 having been completed, the prepared cable ends are inserted into respective ones of cable-receiving recesses 28,58 of subassembly 12. Pin and socket contact sections 102,112 enter profiled bore 82 of inner dielectric sleeve and mate therewithin to define an electrical connection. The ends of inner insulative jackets 162,172 abut end faces of inner dielectric sleeve 80 within recesses 90,92 to stop cable insertion, and in this manner assure that exposed portions of either the inner contact members or the inner cable conductors are surrounded by dielectric material. Cable-receiving recesses 28,58 may have dielectric spacing discs such as 190 therein along recess bottoms 32,62, as seen in FIGS. 3 and 4 against which gently folded forward ends of braids 164,174 may bear and be flexed without damage, with spacing discs 190 having central apertures permitting insertion of an insulated inner cable conductor therethrough.

Inner ferrules 120,140 include outwardly extending flanges 130,150 along rearward faces 124,144 defining forwardly facing surfaces 132,152 abutting rearward ends 26,56 of outer shells 20,50 as a positioning means to define a clearance between inner ferrules 120,140 and recess bottoms 32,62, all to assure that shielding braids 164,174 are not damaged during assembly such as by being improperly compressed or kinked, especially with braids woven of smaller strand wire such as 28 gage. Ends of shielding braids 164,174 are disposed in the gap between the inner surfaces of annular flanges 30,60 of outer shells 20,50 and outwardly facing surfaces 128,148 of inner ferrules 120,140 and the assembly thus formed is ready for crimping. Spacing discs 190 would be especially useful in urging the flared shielding braid further backwardly along outside surfaces 128,148 of inner ferrules 120,140 during cable end insertion into recesses 28,58 where smaller size cable is being spliced.

As seen in FIG. 4, annular flanges 30,60 of outer shells 20,50 are crimped radially inwardly a slight distance against outer surfaces 128,148 of inner ferrules 120,140 trapping braid ends therebetween and establishing an assured grounding contact between the shielding braids 164,174 and outer shells 20,50. Standard crimping tools are used, with crimping dies selected to provide a precisely slight, smoothly arcuate reduced diameter to annular flanges 30,60, with the reduced diameter selected to be the outer diameter of inner ferrules 120,140 as a nonreduceable support surface, so selected to provide firm compression of the thus-deformed outer shell annular flanges to the shielding braid and inner ferrules without damaging the shielding braids which are compressed firmly against preferably knurled surfaces of the inner ferrules.

Optionally, a length of heat recoverable or fusible tubing may be used as a sealing sleeve encasing the splice connection and providing a level of strain relief minimizing incremental cable end movement within the connection. A sleeve 200 is shown in FIGS. 1 and 4 to initially have an inner diameter larger than the diameter of the outer conductive shells 20,50 and inner ferrules 120,140, to be placed over one of the cable ends prior to splicing and having a length sufficient for ends 202,204 thereof to extend beyond the inner ferrule ends 124,144 after crimping. Sleeve 200 is then translated over the fully crimped connection after which the sleeve becomes reduced in diameter upon application of sufficient thermal energy, shrinking to conform tightly against the outer surfaces of the splice connection and against insulated portions of the cables extending from the splice, and its material tackifying to generate a bond with the cable jackets. Optionally the sleeve may contain sealant preforms 206,208 at and within each end 202,204 which provide assured bonding between the sleeve ends and the insulative cable jackets circumferentially therearound, after first melting and then solidifying and curing. Such heat recoverable sleeves and sealant preforms are disclosed in U.S. Pat. No. 3,525,799; 4,341,921 and 4,595,724, and may be made, for example, of polyvinylidene fluoride or polyurethane for the sleeve, and a mixture of PVDF, methacrylate polymer, antimony oxide and zinc oxide for the sealant preforms.

It is seen that splice connector 10 can easily be provided as a kit of parts especially adapted for use to splice together coaxial cables of the same or differing standard diameters, with inner contacts and inner ferrules for use with cables of the particular sizes encountered in the field. It is also seen that technique sensitivity has been minimized, resulting in easily formed crimped connections of assured quality.

I claim:

1. A kit of parts for forming a crimped connection between two coaxial cables having respective known sizes and having outer jackets, shielding braids, inner insulative jackets and inner conductors of known sizes, comprising:

an outer conductor containing an inner dielectric sleeve and defining a subassembly, the subassembly having thinwalled annular flanges at respective outer ends thereof defining large cable-receiving recesses at and extending inwardly from said outer ends thereof, and a contact-receiving bore extending through said inner dielectric sleeve in communication with said large cable-receiving recesses and centered with respect thereto;

at least one male inner contact member adapted to be terminated to a respective inner conductor of one of said coaxial cables, and at least one female inner contact member adapted to be terminated to a respective inner conductor of the other of said coaxial cables, said at least one male and at least one female inner contact member including complementary pin and socket contact sections at forward ends thereof matable upon being urged together during splicing; and at least two inner ferrules of incompressible material having forward sections having outer diameters selected to be less than the inner diameters of said large cable-receiving recesses of said subassembly to define an annular space around said forward sections upon insertion into said large cable-receiving recesses, and further having an outwardly extending flange along a rearward face thereof at least large enough in outer diameter to define a stop surface to abut a respective outer end of said subassembly upon insertion, with said forward sections of said inner ferrules having axial lengths less than the selected depth of said large cable-receiving recesses, each said inner ferrule having a central passageway therethrough extending from said rearward face to a forward face thereof having an inner diameter selected to permit insertion therethrough of a particular size of coaxial cable with which said inner ferrule is to be associated, whereby said inner ferrules are placeable onto ends of respective said coaxial cables, and said ends of said coaxial cables are prepared by removal of a selected length of the outer jackets thereof, the shielding braids thus exposed are foldable backwardly over said forward face and an outwardly facing surface of respective said inner ferrules extending rearwardly from said forward face, and the inner conductors are terminatable onto respective said inner contact members, and the thus-prepared cable ends are inserted into respective said large cable-receiving recesses with said inner contact members inserted into said bore of said inner dielectric sleeve until said contact sections thereof mate, and said inner ferrules are insertable into said large cable-receiving recesses until said stop surfaces thereof abut said rearward ends of said outer conductor, whereafter said shielding braids are disposed between said annular flanges of said outer conductor and said inner ferrules, and said annular flanges are crimpable inwardly into said annular space to form a crimped connection with said shielding braids and also define a mechanical joint between said coaxial cables.

2. A kit of parts as set forth in claim 1 wherein outer surfaces of said forward sections of said at least two inner ferrules are knurled.

3. A kit of parts as set forth in claim 1 wherein said central passageway of at least one of said inner ferrules has an inner diameter only slightly larger than a coaxial cable of a first known size, said central passageway of at least one other of said inner ferrules has an inner diameter only slightly larger than a coaxial cable of a second known size different from said first known size, at least one of said male inner contact members includes a conductor-receiving barrel only slightly larger than an inner conductor of said coaxial cable of said first known size, and at least one of said female inner contact members includes a conductor-receiving barrel only slightly larger than an inner conductor of said coaxial cable of said second known size, all whereby said kit of parts is adapted to splice coaxial cables of two different known sizes.

4. A kit of parts as set forth in claim 1 further including a length of heat recoverable fusible tubing to extend beyond ends of the splice connection, for sealing the splice connection when reduced in diameter by thermal energy to grip portions of the outer jackets of the cables extending from the splice connection.

5. A kit of parts as set forth in claim 1 wherein said forward section of each said inner ferrule has an axial dimension selected to provide a clearance between said forward face and a bottom surface of a respective said large cable-receiving recess of said subassembly upon insertion thereinto and abutment of said stop surface with said outer end with a folded-over section of said shielding braid of a said coaxial cable disposed freely in said clearance.

6. A kit of parts as set forth in claim 5 further including a pair of dielectric spacer discs adapted to be placed transversely in respective said large cable-receiving recesses and apertured to permit insertion therethrough of ends of respective said coaxial cables forwardly of said folded-back shielding braid.

7. A kit of parts as set forth in claim 1 wherein said subassembly includes a unitary cylindrical inner dielectric sleeve of selected axial length and outer diameter, and first and second outer conductive shell members each including a rearward face containing a said annular flange and having sleeve-receiving profiled bore forward portions extending from first and second forward faces to reduced diameter central sections associated with ends of said inner dielectric sleeve for retention of said sleeve within said subassembly, said reduced diameter central sections being in communication with and centered with respect to respective said annular flanges at said rearward ends of said first and second outer conductive shells to expose said contact-receiving bore of said inner dielectric sleeve, and said first and second forward faces include complementary interfitting portions to define a press fit when said first and second outer conductive shell members are placed over respective ends of said inner dielectric sleeve and pressed together.

8. A kit of parts as set forth in claim 7 wherein said forward face of said first outer conductive shell includes an annular flange extending axially therefrom, and said forward face of said second outer conductive shell includes a complementary recess thereinto for press fit receipt of said annular flange thereinto during assembly of said subassembly.

9. A kit of parts as set forth in claim 1 wherein said large cable-receiving recesses have identical inner diameters and said at least two inner ferrules have identical outer diameters of said forward sections thereof.

10. A kit of parts as set forth in claim 9 wherein said central passageway of at least one of said inner ferrules has an inner diameter only slightly larger than a coaxial cable of a first known size, said central passageway of at least one other of said inner ferrules has an inner diameter only slightly larger than a coaxial cable of a second known size different from said first known size, at least one of said male inner contact members includes a conductor-receiving barrel only slightly larger than an inner conductor of said coaxial cable of said first known size, and at least one of said female inner contact members includes a conductor-receiving barrel only slightly larger than an inner conductor of said coaxial cable of said second known size, all whereby said kit of parts is adapted to splice coaxial cables of two different known sizes irrespective of which outer end of said subassembly each said prepared coaxial cable end is inserted.

11. A splice connection of a first coaxial cable of a selected first size and a second coaxial cable of a selected second size, the first and second coaxial cables having outer jackets, shielding braids, inner insulative jackets and inner conductors of known sizes, comprising:

an outer conductor having large recesses at opposed ends thereof defined by annular flanges extending axially outwardly, and having secured centered therewithin an inner dielectric sleeve having a central bore extending therethrough extending between said opposed ends of said outer conductor, with said central bore of said inner dielectric sleeve in communication with and centered with respect to said large recesses;

first and second inner ferrules having central passageways through which extend ends of said first and second coaxial cables and having forward portions disposed within respective ones of said large recesses of said outer conductor; and an end portion of said first coaxial cable and an end portion of said second coaxial cable each previously prepared by removal of a selected length of the outer jacket thereof, each of the shielding braids thus exposed folded backwardly over a forward face and an outwardly facing surface of said forward portion of a respective one of said first and second inner ferrules extending rearwardly from said forward face, each of the inner conductors exposed forwardly of inner insulative jacket terminated onto a respective inner contact member, and the thus-prepared cable ends disposed within respective large cable-receiving recesses into respective ones of said opposed ends of said outer conductor with said inner contact members extending into and along a bore of said inner dielectric sleeve with contact sections thereof mated, and said inner ferrules with ends of said shielding braids folded back thereover are disposed in said large cable-receiving recesses, with said shielding braids disposed between annular flanges of said outer conductor and said inner ferrules, and said annular flanges are crimped inwardly into said annular space forming a crimped connection with said shielding braids, and also defining a mechanical joint between said coaxial cables.

12. A splice connection as set forth in claim 11 wherein said selected size of said first coaxial cable is different from said selected size of said second coaxial cable, said central passageway of said first inner ferrule has an inner diameter corresponding to said selected size of said first coaxial cable and said central passageway of said second inner ferrule has an inner diameter corresponding to said selected size of said second coaxial cable.

13. A method of splicing an end of a first coaxial cable to an end of a second coaxial cable, the coaxial cables having outer jackets, shielding braids, inner insulative jackets and inner conductors of known sizes, comprising the steps of:

providing an outer conductor having large recesses at opposed ends thereof defined by annular flanges extending axially outwardly, and having secured centered therewithin an inner dielectric sleeve having a central bore extending therethrough extending between said opposed ends of said outer conductor, with said central bore of said inner dielectric sleeve in communication with and centered with respect to said large recesses;

providing first and second inner contact members having complementary contact sections at forward ends thereof and conductor-receiving barrels at rearward ends thereof, and each having an outer diameter selected to fit within said central bore of said inner dielectric sleeve;

providing first and second inner ferrules having central passageways adapted to receive ends of said first and second coaxial cables and having forward portions adapted to be disposed within respective ones of said large recesses of said outer conductor;

placing said first and second inner ferrules onto ends of respective said first and second coaxial cables with said forward portions facing the cable ends;

preparing said ends of said coaxial cables by removal of a selected length of the outer jackets thereof exposing lengths of the shielding braids, folding the shielding braids backwardly over said forward portion and along an outwardly facing surface of respective said first and second inner ferrules extending rearwardly from said forward face;

removing a length of the inner insulative jacket from the end of each said first and second coaxial cable exposing a length of the inner conductor, and inserting the exposed inner conductors of said first and second coaxial cables into a said conductor-receiving barrel of a corresponding one of said first and second inner contact members and terminating the inner conductors onto respective said inner contact members;

inserting the thus-prepared cable ends into respective said large cable-receiving recesses with said inner contact members inserted into said central bore of said inner dielectric sleeve until said contact sections thereof mate and said inner insulative jackets abut an end face of said inner dielectric sleeve, and urging said inner ferrules into said large cable-receiving recesses until said stop surfaces thereof abut said rearward ends of said outer conductor, whereafter said shielding braids are disposed between said annular flanges of said outer conductor and said inner ferrules; and crimping said annular flanges inwardly into said annular space and firmly against said outwardly facing surfaces of said forward portions of said first and second inner ferrules and said shielding braid ends lying thereon, to form a crimped connection with said shielding braids and also define a mechanical joint between said coaxial cables.

14. The method as set forth in claim 13 wherein said first coaxial cable is of a first selected size and said second coaxial cable is of a second selected size different from said first selected size;

said step of providing said first and second inner contact members includes providing a first said inner contact member having a said conductor-receiving barrel having an inner diameter slightly larger than the diameter of the inner conductor of said first coaxial cable and providing a second said inner contact member having a said conductor-receiving barrel having an inner diameter slightly larger than the diameter of the inner conductor of said second coaxial cable; and said step of providing said first and second inner ferrules includes providing a first said inner ferrule having a central passageway having an inner diameter slightly larger than said first selected cable size, and providing a second said inner ferrule having a central passageway having an inner diameter slightly larger than said second selected cable size.

* * * * *